US010960698B2

(12) United States Patent
Beabes et al.

(10) Patent No.: US 10,960,698 B2
(45) Date of Patent: Mar. 30, 2021

(54) SYSTEMS AND METHODS FOR PRINTING OF REMOVABLE AND PERMANENT IMAGES ON AN OBJECT

(71) Applicant: Xerox Corporation, Norwalk, CT (US)

(72) Inventors: Minette A. Beabes, Rochester, NY (US); Brendan C. Casey, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 32 days.

(21) Appl. No.: 16/226,775

(22) Filed: Dec. 20, 2018

(65) Prior Publication Data

US 2020/0198387 A1 Jun. 25, 2020

(51) Int. Cl.
*B41M 5/00* (2006.01)
*B65D 65/22* (2006.01)
(Continued)

(52) U.S. Cl.
CPC ..... *B41M 5/0047* (2013.01); *B41M 5/007* (2013.01); *B41M 5/0064* (2013.01);
(Continued)

(58) Field of Classification Search
CPC ..... B41M 5/0047; B41M 7/0009; B41M 5/0064; B41M 5/007; B41M 3/008; B41M 5/0088; B41M 5/0011; B41M 5/0017; B41M 5/0023; B41M 7/00; B41M 7/0072; B41M 5/52; B41M 5/5218; B41M 5/5227; B65D 65/22; B65D 25/34; B65D 23/0828; B65D 2565/385; B41J 2/01; B41J 2/211; B41J 2/1433; B41J 2/17; B41J 2/17593; B41J 2/2107; B41J 2/1755; B41J 2/2114; B41J 2/2117; B41J 2/2056; B41J 2/21; B41J 2/0057; B41J 3/60; B41J 2002/012; B41J 2/04598; B41J 2/1623; B41J 2202/00; B41J 2202/03; B41J 2/14201; B41J 2/045; B41J 11/0015; B41J 11/002; B41J 2/04581; B41J 2/055; B41J 2/16538; B41J 2002/16502; B41J 2/04588; B41J 2/04595;
(Continued)

(56) References Cited

U.S. PATENT DOCUMENTS 5,791,110 A * 8/1998 Traynor ..... A63F 9/06 428/49
2006/0250464 A1* 11/2006 Sheinman ..... B41J 11/002 347/101

(Continued)

*Primary Examiner* — Manish S Shah
(74) *Attorney, Agent, or Firm* — Fox Rothschild LLP

(57) ABSTRACT

Systems and methods for printing a plurality of images on an object include receiving a digital file having a plurality of images (removable and/or permanent) to be printed on an object. The method further includes, for each of the plurality of images: determining whether that image is a removable image or a permanent image, identifying, based on the determination, at least one layer to be used for printing that image in addition to a marking material layer, determining a composition of the marking material layer, and determining a composition of the at least one layer. The at least one layer may be a pre-coat layer applied under the marking material layer and/or a post-coat layer applied over the marking material layer. The marking material layer and the at least one layer are then printed on the object.

25 Claims, 5 Drawing Sheets

(51) Int. Cl.
*B65D 25/34* (2006.01)
*B41M 7/00* (2006.01)
*B65D 23/08* (2006.01)

(52) U.S. Cl.
CPC ..... *B41M 7/0009* (2013.01); *B65D 23/0828* (2013.01); *B65D 25/34* (2013.01); *B65D 65/22* (2013.01); *B65D 2565/385* (2013.01)

(58) Field of Classification Search
CPC ... B41J 2/04586; B41J 2/14274; C09D 11/36; C09D 11/40; C09D 11/30; C09D 11/38; C09D 11/32; C09D 11/322; C09D 11/324; C09D 11/328; C09D 11/101; C09D 11/102; C09D 11/005; C09D 11/54; C09D 11/52; C09D 11/106
See application file for complete search history.

(56) References Cited

U.S. PATENT DOCUMENTS

| | | | | |
|---|---|---|---|---|
| 2008/0117248 | A1* | 5/2008 | Uptergrove ..... | B41J 2/17509 347/16 |
| 2010/0096386 | A1* | 4/2010 | Uptergrove ..... | B41M 5/0017 220/62.11 |
| 2014/0375046 | A1* | 12/2014 | Wang ..... | B42D 25/21 101/450.1 |
| 2016/0222228 | A1 | 8/2016 | Uptergrove et al. | |

* cited by examiner

SYSTEMS AND METHODS FOR PRINTING OF REMOVABLE AND PERMANENT IMAGES ON AN OBJECT

BACKGROUND

Reusable containers and bottles (made from for example, glass, plastic, or the like) typically include one or more labels adhered to their outer surface. Such containers and bottles are available in a wide variety of shapes and sizes for holding many different types of materials such as detergents, chemicals, motor oil, beverages, including juices, soft drinks, alcoholic beverages, etc. The labels may include colors, designs, logos, and information concerning the product or manufacturer and details as to the contents of the container.

While such containers and bottles are reusable, the bottles must be cleaned and the labels removed prior to refilling and relabeling the bottles often because the materials used to make the labels are not recyclable. As such, label requirements generally include high clarity visual aesthetics, abrasion resistance during processing and handling of beverage bottles, and resistance to any deleterious effects due to moisture during cold storage or a pasteurization process. However these requirements can be difficult to achieve and still require easy removability of the label from the bottle. When the labels are not easily separable from the containers, many containers are not recycled that otherwise would be, and recycling yields are reduced.

Container manufacturers have also recently started producing containers with digitally printed labels that are of a sufficient definition and quality to compete with and potentially replace prior conventional labeling techniques. As such, there is a desire for digitally printed plastic articles, such as containers, that have digital images that adhere to the article without quality issues throughout its useful life, but are readily removable by customers and/or using conventional recycling processes developed for removing conventional labels. It will also be advantageous to digitally print removable labels or images as well as permanent images on a container in a single step (i.e., in a single manufacturing line) so as to avoid handling and tracking of the container between various printing devices or manufacturing lines.

The current disclosure discloses a methods and systems for printing of permanent images and removable images (labels) on containers or other objects in a single manufacturing line.

SUMMARY

In one aspect of the disclosure, systems and methods for printing a plurality of images on an object are disclosed. In certain embodiments, the system includes a plurality of print heads, a plurality of layer applicators, a processor, and a non-transitory computer-readable medium. The non-transitory computer readable medium comprises programming instructions that are configured to cause the processor to receive a digital file comprising a plurality of images to be printed on an object, wherein the plurality of images comprise one or more removable images and one or more permanent images. The programming instructions are also configured to cause the processor to, for each of the plurality of images: determine whether that image is a removable image or a permanent image, identify, based on the determination, at least one layer to be used for printing that image in addition to a marking material layer, wherein the at least one layer comprises a pre-coat layer applied under the marking material layer or a post-coat layer applied over the marking material layer, determine a composition of the marking material layer, and determine a composition of the at least one layer. The processor then operates the plurality of print heads to eject marking material based on the determined composition of the marking material layer for each of the plurality of images. The processor also operates the plurality of layer applicators to apply the identified at least one layer based on the determined composition of the at least one layer for each of the plurality of images by applying the marking material layer over the at least one layer if it is a pre-coat layer and under the at least one layer if it is a post-coat layer.

In certain embodiments, the digital file may also include metadata corresponding to each of the plurality of images. Metadata may include information such as, without limitation, color information, background information, location of printing an image, information relating to whether an image removable or permanent, and/or information relating to whether a portion of an image is removable or permanent.

In certain embodiments, determining whether that image is a removable image or a permanent image comprises making the determination based on metadata associated with that image, type of information included in that image, location of that image on the object, user instructions, and/or a type of the object.

In one or more embodiments, identifying, based on the determination, at least one layer to be used for printing that image in addition to the marking material layer comprises making the identification based on at least one of the following rules: a pre-coat layer if that image is determined to be a permanent image, a post-coat layer if that image is determined to be a permanent image, a pre-coat layer if that image is determined to be a removable image, and/or a post-coat layer if that image is determined to be a permanent image.

In some embodiments, if the image is determined to be a removable image, determining the composition of the at least one layer may include determining the composition to improve removability of the marking material layer from a surface of the object. Optionally, if the layer is a pre-coat layer, the composition may be determined based on, for example, a pre-coat layer that has a thermal expansion coefficient that is different from that of the object surface, a pre-coat layer that has a solubility coefficient that makes it soluble in one or more solvents such that the pre-coat layer and the marking material layer applied over it may be removed by subjecting the object to the one or more solvents, a pre-coat layer that is soluble in one or more solvents at a pre-determined pH such that the pre-coat layer and the marking material layer applied over it may be removed by subjecting the object to the one or more solvents at the pre-determined pH, and/or a pre-coat layer that forms a substrate under the marking material layer such that that image can be removed by peeling off the substrate. Additionally and/or alternatively, the system may determine that the composition is the pre-coat layer that forms the substrate under the marking material layer such that that image can be removed by peeling off the substrate, and applying a removable tab to a portion, but not all, of the substrate. Optionally, if the layer is a post-coat layer, the composition may be determined based on, for example, a post-coat layer that alters the properties of the marking material layer to reduce adhesion of the marking material layer to the object surface and/or a post-coat layer that prevents damage to that image during transportation or handling but which is removable at suitable temperature, pressure, pH, or solvent exposure.

In some embodiments, if the image is determined to be a permanent image, determining the composition of the at least one layer may include determining the composition to improve adhesion of the marking material layer to a surface of the object. Optionally, if the layer is a pre-coat layer, the composition may be determined based on, for example, a chemical composition of a surface of the object and/or a chemical composition of the marking material. Additionally and/or alternatively, if the layer is a post-coat layer, the composition may be determined based on, for example, such that it forms a protective coat over the marking material layer that prevents removal of the marking material layer.

In at least one embodiment, determining the composition of the marking material may include determining the composition based on, without limitation, metadata associated with that image, properties of the at least one layer, or the determination whether that image is a permanent image and/or a removable image.

In some embodiments, at least one of the plurality of images may include a removable image portion and a permanent image portion. Optionally, at least a first layer may be selected for printing the removable image portion in addition to a first marking material layer and at least a second layer may be selected for printing the permanent image portion in addition to a second marking material layer.

The object may be a product container and the one or more removable images are printed on the product container such that they can be removed by a user before recycling the product container.

In another aspect of the disclosure, systems and methods for determining composition of one or more layers of an image to be printed on an object are disclosed. In certain embodiments, the method may include determining whether an image is a removable image or a permanent image, identifying, based on the determination, at least one layer to be used for printing the image in addition to a marking material layer, wherein the at least one layer is a pre-coat layer applied under the marking material layer or a post-coat layer applied over the marking material layer, determining a composition of the marking material layer, and determining a composition of the at least one layer.

DETAILED DESCRIPTION

Figure 1:
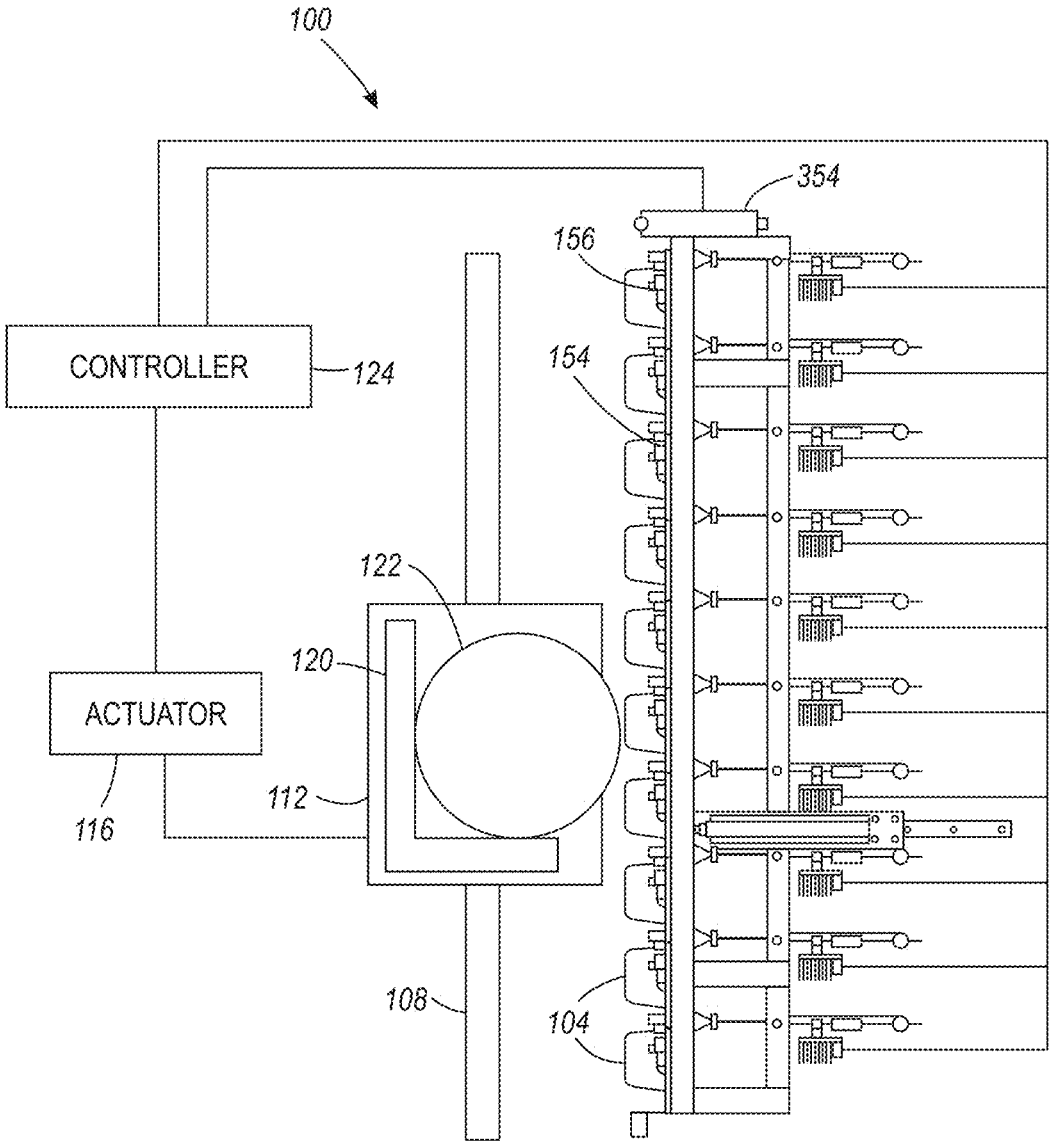
FIG. 1 illustrates an example of a print system for printing on a 3-dimensional object, according to embodiments of this disclosure.

This disclosure is not limited to the particular systems, methodologies or protocols described, as these may vary. The terminology used in this description is for the purpose of describing the particular versions or embodiments only, and is not intended to limit the scope.

As used in this document, any word in singular form, along with the singular forms "a," "an" and "the," include the plural reference unless the context clearly dictates otherwise. Unless defined otherwise, all technical and scientific terms used in this document have the same meanings as commonly understood by one of ordinary skill in the art. All publications mentioned in this document are incorporated by reference. Nothing in this document is to be construed as an admission that the embodiments described in this document are not entitled to antedate such disclosure by virtue of prior invention. As used in this document, the term "comprising" means "including, but not limited to."

The term "container" refers to a multi-dimensional print media substrate configured to hold a material (e.g., beverages, containers, etc.) that is made of any suitable material and on which removable labels and/or permanent images may be printed using the methods disclosed in this disclosure. A container may include planar, curved, non-planar, or non-linear surfaces. Content may be printed on the container using toner and/or ink.

An "image" refers to a collection of data, including image data in any format, retained in an electronic form. In some embodiments, the image may correspond to a pictorial representation of an object or a document.

The term "marking material" refers to any material that can be formed on a surface of an object to form visible marks including monochrome and color printed images that include text and graphics. Examples of marking agents include various forms of ink, including aqueous, solvent based, and phase-change inks. Other forms of marking agent include toner compounds.

The terms "computing device" and "electronic device" interchangeably refer to a device having a processor and a non-transitory, computer-readable medium (i.e., memory). The memory may contain programming instructions in the form of a software application that, when executed by the processor, causes the device to perform one or more processing operations according to the programming instructions. An electronic device also may include additional components such as a touch-sensitive display device that serves as a user interface, as well as a camera for capturing images. An electronic device also may include one or more communication hardware components such as a transmitter and/or receiver that will enable the device to send and/or receive signals to and/or from other devices, whether via a communications network or via near-field or short-range communication protocols. If so, the programming instructions may be stored on the remote device and executed on the processor of the computing device as in a thin client or Internet of Things (IoT) arrangement. Example components of an electronic device are discussed below in the context of FIG. 6. An electronic device that is programmed to generate an electronic file of a document to be printed may be referred to as a "print server."

The terms "memory," "memory device," "computer-readable medium" and "data store" each refer to a non-transitory device on which computer-readable data, programming instructions or both are stored. Unless the context specifically states that a single device is required or that multiple devices are required, the terms "memory," "memory device," "computer-readable medium" and "data store" include both the singular and plural embodiments, as well as portions of such devices such as memory sectors.

A "print device" or "print engine" is a device that is configured to print content on a container based on digital data, or a multi-functional device in which one of the functions is printing content based on digital data. Example components of a print device include a print head, which may include components such as a print cartridge containing ink, toner or another print material so that the print head can print characters and/or images on the container.

A "processor" or "processing device" is a hardware component of an electronic device that is configured to execute programming instructions. The term "processor" may refer to either a single processor or to multiple processors that together implement various steps of a process. Unless the context specifically states that a single processor is required or that multiple processors are required, the term "processor" includes both the singular and plural embodiments.

The term "single step" refers to printing of both permanent and removable images on a container using the same print system in one print cycle and/or manufacturing line.

FIG. 1 illustrates an example of a print system for printing on a container. In some embodiments, the print system 100 may include an array or other set of print heads 104, an array of pre-coat applicators 154, an array of post coat applicators 156, a support member 108, a container holder 120 movably mounted to the support member 108, an actuator 116 operatively connected to the container holder 120, and a controller 124 in communication with the print heads 104, the array of pre-coat applicators 154, the array of post-coat applicators 156, and the actuator 116. As shown in FIG. 1, the array of print heads 104 may be arranged in a two-dimensional array, (e.g., a 10×1 array), although other array configurations can be used. In some embodiments, the controller 124 is also operatively connected to an optical sensor 354.

In some embodiments, each print head of the array of print heads 104 may be fluidly connected to a supply of marking material (not shown) and is configured to eject marking material received from the supply. In various embodiments, one or more of the print heads may be connected to the same supply. Alternatively and/or additionally, each print head may be connected to its own supply such that each print head may eject a different marking material. Similarly, each pre-coat applicator of the array of pre-coat applicators 154 may be fluidly connected to a supply of pre-coat material (not shown) and is configured to eject pre-coat material received from the supply. In various embodiments, one or more of the pre-coat applicators 154 may be connected to the same supply. Alternatively and/or additionally, each pre-coat applicator may be connected to its own supply such that each array of pre-coat applicators 154 may eject a different pre-coat material. Similarly, each post-coat applicator of the array of post-coat applicators 156 may be fluidly connected to a supply of post-coat material (not shown) and is configured to eject post-coat material received from the supply. In various embodiments, one or more of the post-coat applicators 156 may be connected to the same supply. Alternatively and/or additionally, each post-coat applicator may be connected to its own supply such that each array of post-coat applicators 156 may eject a different post-coat material. While FIG. 1 illustrates that the marking material, the pre-coat material, and the post-coat material is ejected from different heads and/or applicators, a single head and/or applicator may be configured to eject any combination of the marking material, the pre-coat material, and/or the post-coat material.

In various embodiments, the support member 108 may be positioned to be parallel to a plane formed by the array of print heads 104, the array of pre-coat applicators 154, the array of post-coat applicators 156, and as shown in FIG. 1, is oriented so one end of the support member 108 is at a higher gravitational potential than the other end of the support member. This orientation enables the printing system 100 to have a smaller footprint than an alternative embodiment that horizontally orients the array of print heads. While FIG. 1 illustrates a single rail acting as a support member 108, it will be understood to those skilled in the art that a plurality of rails disposed parallel to each other are within the scope of this disclosure.

In some embodiments, the container holder 120 is movably mounted to the support member 108 to enable the moving sled to slide along the support member. In some embodiments, the moving sled 112 may move bi-directionally along the support member. In other embodiments, the container holder 120 may be configured to provide a return path to the lower end of the support member to form a track for the movably mounted member. In some embodiments, an actuator 116 may be operatively connected to the container holder 120 and configured to move the container holder 120 along the support member 108 such that the container holder 120 may pass the array of print heads 104, the array of pre-coat applicators 154, and/or the array of post-coat applicators 156, in one dimension of the two-dimensional array of print heads. In the embodiment, the container holder 120 moves a container 122 along the length dimension of the array of print heads 104, the array of pre-coat applicators 154, and/or the array of post-coat applicators 156.

The controller 124 is configured with programmed instructions stored in a memory in communication with the controller so the controller can execute the programmed instructions to operate components in the printing system 100. In some embodiments, the controller 124 may be configured to provide instruction to the actuator 116 to move the container holder 120 past the array of print heads 104, the array of pre-coat applicators 154, and/or the array of post-coat applicators 156. The controller may also be configured to operate the array of print heads 104, the array of pre-coat applicators 154, and/or the array of post-coat applicators 156 to eject marking material, pre-coat material, and/or the post-coat material onto containers held by the container holder 120 as the container holder passes the array of print heads 104, the array of pre-coat applicators 154, and/or the array of post-coat applicators 156.

Alternatively and/or additionally, the container holder 120 may be stationary and the print heads 104, the array of pre-coat applicators 154, and/or the array of post-coat applicators 156 may move with respect to the container holder 120.

Figure 2:
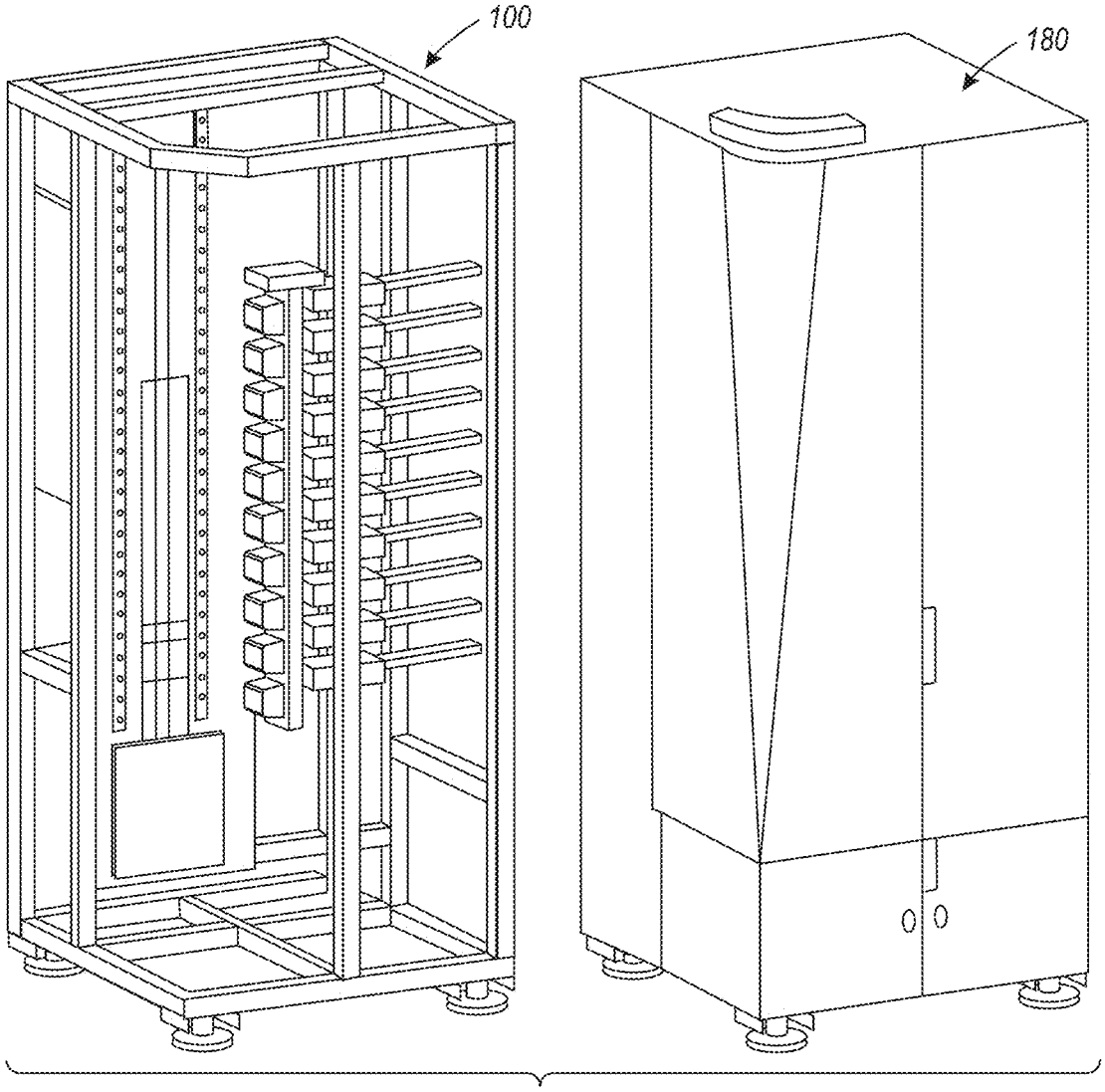
FIG. 2 illustrates an example cabinet within which the print system if FIG. 1 may be installed, according to embodiments of this disclosure.

In various embodiments, the system configuration such as that shown in FIG. 1 may be housed in a single cabinet 180, as depicted in FIG. 2, and installed in non-production outlets. Once installed, various container holders, as described further below, can be used with the system to print a variety of goods that are generic in appearance until printed.

Figure 3:
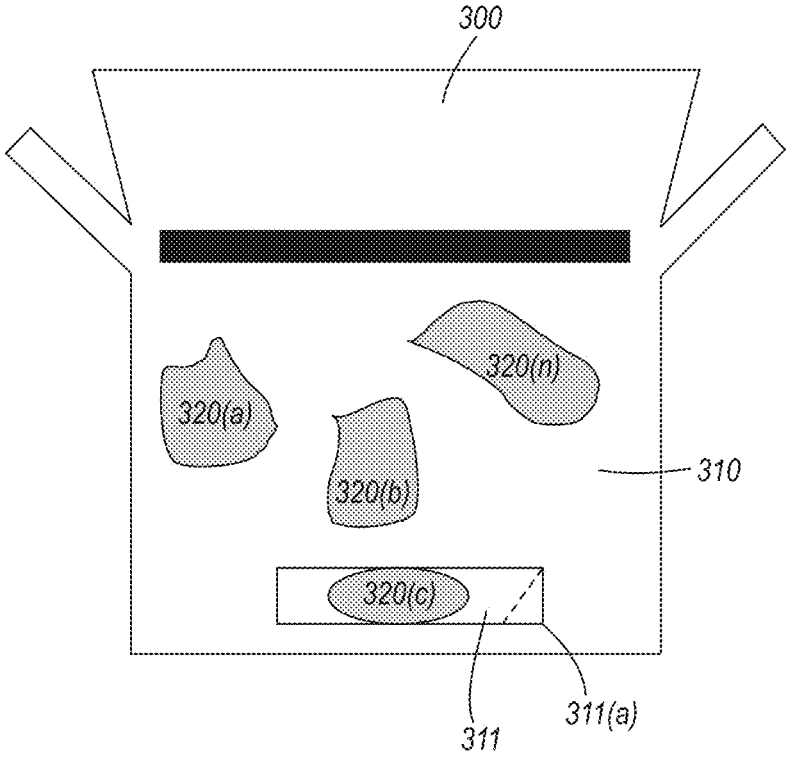
FIG. 3 illustrates an example container on which a plurality of images are printed according to embodiments of this disclosure.

Referring now to FIG. 3, an example portion of a surface 310 of a container 300 that includes a plurality of printed images (320(*a*), 320(*b*), 320(*c*), . . . 320(*n*)) is shown. Each of the plurality of images may be either a removable image or a permanent image. It should be noted that while FIG. 3 illustrates one removable image portion and one permanent image portion, the disclosure is not so limiting and any number of removable and permanent image portions may be present. The container 300 may be made of materials such as, without limitation, glass, ceramic, plastic, resin, or the like.

In some embodiments, the permanent image(s) cannot be removed, and the removable image(s) may be removed under appropriate conditions by a user of the container 300.

For example, a removable image may be removed by exposing the removable image to a threshold temperature, to certain chemicals and/or solvents, to a threshold pressure, or a combination thereof (discussed below). Alternatively and/or additionally, a removable image may be printed on a substrate 311 with a peel off tab portion 311(*a*) configured to allow the removable image to be removed by peeling off of substrate 311.

In certain embodiments, a single image may include a removable portion and a permanent portion which may be printed using the principles described herein.

In some embodiments, the container may include one or more pre-coat layers applied under the printed permanent image(s) and/or the printed removable image(s). As used in this disclosure, "pre-coat" refers to a material that when applied on the surface of a container (before the application of the marking material) modifies (1) the surface properties of the container (e.g., surface tension, adhesion properties, or the like) to promote and/or reduce adhesion properties of the marking material on the container surface, (2) forms a substrate or surface under the marking material that has different properties compared to those of the container surface (e.g., thermal expansion coefficient, solubility in solvents, pH reactivity, or the like), and/or (3) forms a substrate or surface under the marking material that may be peeled off under suitable conditions, such that when marking material is applied over the pre-coat, removability of the marking material is governed by the pre-coat applied. The pre-coat may be transparent or may provide a desired background color (e.g., white, grey, etc.) for the images to be printed over the pre-coat.

Alternatively and/or additionally, one or more post-coat layers may be applied over the printed permanent image(s) and/or the printed removable image(s). As used in this disclosure, "post-coat" refers to a material that when applied over the marking material modifies the properties of the marking material (e.g., adhesion properties, thermal expansion coefficient, solubility in different solvents, pH reactivity, or the like), and governs the removability of the marking material. The post-coat material may also protect the printed image from degradation during handling, may be used for decorative purposes (e.g., to provide a gloss finish, a matte finish, or the like).

The pre-coat material and the post-coat material may be selected based on, for example and without limitation, properties of the surface material of the container (e.g., material, texture, thickness, expansion coefficient, solubility, or the like), properties of the marking material to be used (e.g., chemical composition of the ink or toner, color, temperature stability, etc.), the type of image to be printed (i.e., permanent or removable), methods to be used for removing the image, container handling constraints, intended function of the pre-coat or post-coat material, or the like.

For example, a pre-coat layer may be chosen for a removable image to impart properties that assist in easy removability of the removable image under the right conditions, and a post-coat layer may be chosen to further aid in removability and/or to prevent degradation during handling, transport, etc. without hampering removability. Similarly, a pre-coat layer may be chosen for a permanent image to impart properties that improve adhesion of the permanent image, and a post-coat layer may be chosen to further prevent degradation. In certain embodiments, both a pre-coat and a post-coat may be applied to an image portion. Alternatively, either a pre-coat or a post-coat may be applied.

Examples of the pre-coat material used under the printed permanent image portion 311 may include, without limitation, ink primers and/or ink adhesion promoters that improve the adhesion of the permanent images (e.g., Bond Aid™, InkFuze™, Nazdar7025™, Triangle Bond Aid™, or the like). The ink primer is typically comprised of a lacquer and a diluent. The lacquer is typically comprised of one or more polyolefins, polyamides, polyesters, polyester copolymers, polyurethanes, polysulfones, polyvinylidine chloride, styrene-maleic anhydride copolymers, styrene-acrylonitrile copolymers, ionomers based on sodium or zinc salts or ethylene methacrylic acid, polymethyl methacrylates, acrylic polymers and copolymers, polycarbonates, polyacrylonitriles, ethylene-vinyl acetate copolymers, and mixtures of two or more thereof. Examples of the diluents that can be used include alcohols such as ethanol, isopropanol and butanol; esters such as ethyl acetate, propyl acetate and butyl acetate; aromatic hydrocarbons such as toluene and xylene; ketones such as acetone and methyl ethyl ketone; aliphatic hydrocarbons such as heptane; and mixtures thereof. Pre-coat materials such as polyurethane, polyurethane acrylate, or the like, may be chosen for improving adhesion of marking material on the container surface for preventing washing off of the permanent image using caustic washes, high temperature washes, or the like. Pre-coat material that includes ink-receptive compositions (such as a binder and a pigment such as silica or talc, dispersed in the binder; silane agents; etc.) also enhance the printability and permanency of the label. Pre-coat materials may also include surface tension modifiers to improve the adhesion of the marking material on the surface of the container.

The post-coat layer used over the printed permanent image portion 311 provides desirable properties to the label before and after the label is affixed to a substrate such as a container. The presence of a post-coat layer, in some embodiments, provides additional properties to the permanent image such as antistatic properties stiffness and/or weatherability, and the post-coat material may protect the permanent image from degradation because of exposure to, e.g., weather, sun, abrasion, moisture, water, etc. The post-coat layer can enhance the properties of the underlying permanent image to provide a glossier and richer image. The post-coat layer may also be designed to be abrasion resistant, radiation resistant (e.g., UV), chemically resistant, thermally resistant thereby protecting the permanent image from degradation from such causes. The protective post-coat layer is useful on containers subjected to subsequent liquid processing such as bottle washing/rinsing, filling and pasteurization, or liquid immersion (e.g., ice bath) without displaying adverse consequences such as washing off of the permanent image. Examples of the post-coat material used over the printed permanent image portion 311 may include, without limitation, polyolefins, thermoplastic polymers of ethylene and propylene, polyesters, polyurethanes, polyacryls, polymethacryls, vinyl acetate homopolymers, co- or terpolymers, ionomers, and mixtures thereof.

The pre-coat layer under the removable image portion 312 may impart properties such as dissolution in certain solvents (e.g., caustic washes, acidic washes, water, etc.), at certain temperatures, at certain pressures, or the like. For example, hydrophilic monomers such as those having oxygen or nitrogen atoms, in addition to halogens, in their backbone structure are soluble in water and ketones and may be used in the pre-coat layer. The pre-coat layer under the removable image may also include temperature sensitive materials that typically have a glass transition temperature below that of the temperature typically utilized in conventional recycling processes and that dissolve in solvents such as water above a threshold temperature (e.g., thermally activable polyurethanes). The under the removable image may also include pressure sensitive materials that aid in removal of the removable image upon application of pressure.

The post-coat layer over the removable image portion 312 may be chosen such that it prevents degradation of a removable image during transportation, handling, and/or normal usage of the container, but does not impeded removal during recycling. Examples of the post-coat material used over the printed removable image portion 312 may include, without limitation, clear coat varnish, polyolefins, thermoplastic polymers of ethylene and propylene, polyesters, polyurethanes, polyacryls, polymethacryls, vinyl acetate homopolymers, co- or terpolymers, ionomers, and mixtures thereof. Additionally and/or alternatively, the thickness of the post-coat layer over the removable image portion may be configured to allow for easy removal, using for example, peeling off of the marking material adhered to the post-coat layer.

Figure 4:
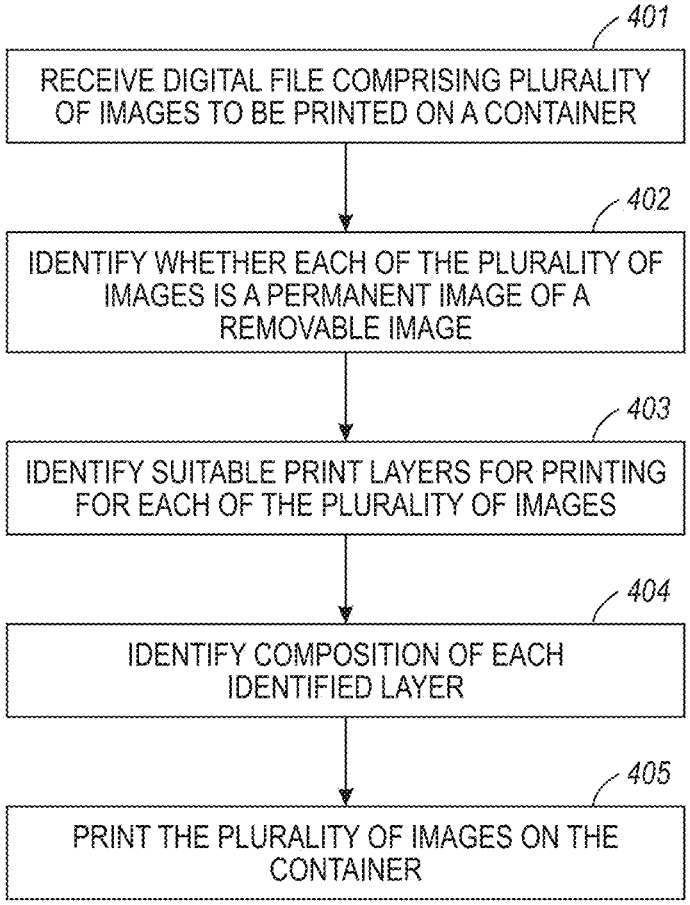
FIG. 4 is a flowchart illustrating an example method for printing of permanent and removable images on a container, according to embodiments of this disclosure.

FIG. 4 is a flowchart illustrating an example method for printing of the plurality of images in a permanent image portion and/or a removable image portion of a container surface (e.g., using the systems disclosed in FIGS. 1-2). While the method 400 is described for the sake of convenience and not with an intent of limiting the disclosure as comprising a series and/or a number of steps, it is to be understood that the process does not need to be performed as a series of steps and/or the steps do not need to be performed in the order shown and described with respect to FIG. 4, but the process may be integrated and/or one or more steps may be performed together, or the steps may be performed in the order disclosed or in an alternate order.

At step 401, the system may receive a digital file comprising a plurality of images to be printed on a container. The digital file may also include information (or metadata) regarding printing of each of the plurality of images such as, without limitation, color information, background information, location of printing on the container, information relating to or for identifying whether an image and/or a portion of an image is removable or permanent, or the like.

The system may then determine (402), for each of the plurality of images, whether it is to be printed as a permanent image, as a removable image, or as a combination of a permanent image portion and a removable image portion. The system may make the determination based on, for example, metadata associated with the image, type of information included in the image (or image portions), location of the image or image portions on the container, user instructions, the type and intended use of the container (e.g., recyclable or not), background color of the image or image portions (e.g., certain background colors may be associated with either a permanent image or a removable image), or the like. For example, the metadata associated with the image may identify the image as a temporary image, as a permanent image, or as a combination of a permanent image portion and a removable image portion. Alternatively and/or additionally, the system may make the determination based on a rule set relating to the type of information included in the image or image portions. For example, the rule set may specify that if an image or image portion includes manufacturer related information, barcodes, logos, expiration dates, content information, etc., it must be identified as a removable image. Similarly, an image or image portion including decorative graphics, recyclable content or colors, etc. must be identified as a permanent image. In another example, the system may make the determination based on a rule set relating to the location of the image or image portion on the container. For example, the rule set may specify that certain locations of the container must include permanent images only, certain other areas of the container cannot include permanent images, certain locations of the container must include removable images only, and/or certain other areas of the container cannot include removable images.

At step 403, the system may determine or identify for each of the plurality of images (or image portions of a single image) the suitable print layers for printing the image. For example, the system may identify for each of the plurality of images whether a pre-coat will be applied and/or whether a post-coat will be applied in addition to the marking material. The system may then identify (404) the composition of the identified layers and the marking material. For example, the system may identify whether a pre-coat will be applied and its composition, the marking material layer composition, and/or whether a post-coat will be applied and its composition. Alternatively and/or additionally, a user may provide some or all of the information relating to the suitable print layers and their compositions for one or more of the images.

In some embodiments, the system may determine whether a pre-coat will be applied and its composition based on, for example, properties of the surface material of the container (e.g., material, texture, thickness, expansion coefficient, solubility, or the like), properties of the marking material to be used (e.g., chemical composition of the ink or toner, color, temperature stability, etc.), the type of image to be printed (i.e., permanent or removable), methods to be used for removing the image, container handling constraints, intended function of the pre-coat, or the like.

In some embodiments, the system may determine that a pre-coat layer will be applied if an image is a removable image to provide removability properties to the image under certain conditions. For example, the pre-coat layer composition may be selected to have a thermal expansion coefficient that is different from that of the container surface such that the pre-coat layer (and the marking material applied over it) may be removed by heating the container to a suitable temperature. Similarly, a pre-coat layer may be selected for a removable image that has a solubility coefficient that makes it soluble in certain solvents and/or at certain pH such that the pre-coat layer (and the marking material applied over it) may be removed by subjecting the container to the solvent and/or pH. Optionally, a pre-coat layer may be selected for a removable image that makes a substrate under the marking material which has a peel off tab for removing the marking material by peeling off the substrate.

In another example, a pre coat layer composition for a removable image may be selected such that it forms a substrate or surface under the marking material that may be peeled off under suitable conditions. A tab portion may be included in such a pre-coat layer that can be lifted, scratched, or otherwise used to start the peeling off process.

In another embodiment, the system may determine that a pre-coat layer will be applied if the image is a permanent image. The system may then determine its composition such that the pre-coat layer may improve the adhesiveness of the marking material on the container surface based on the chemical composition of the container surface and/or the marking material. For example, the pre-coat layer may change the surface properties of the container (e.g., friction of coefficient, chemical bonds formed, improving the smoothness, cleaning the surface contaminants, etc.) and/or the marking material.

Alternatively, the system may determine that a pre-coat layer needs to be applied based on other image properties such as, without limitation, to provide a background color to an image, for providing desired visual characteristics, etc.

In certain embodiments, the system may determine a composition of the marking material layer based on the metadata associated with the image that provides the background color and the CMYK color information for the image, properties of the pre-coat layer (if applied), properties of the post-coat layer (if applied), and/or the image type (i.e., removable or permanent). The marking material may include ink, toner, primer, or other suitable materials. Furthermore, the composition of the marking material may selected based on whether the image is removable or permanent by selecting marking material that adheres either temporarily (i.e., can be removed under suitable conditions such as wiping/washing with a suitable solvent, etc.) or permanently to the container surface.

In some embodiments, the system may determine whether a post-coat will be applied and its composition based on, for example, properties of the surface material of the container (e.g., material, texture, thickness, expansion coefficient, solubility, or the like), properties of the marking material to be used (e.g., chemical composition of the ink or toner, color, temperature stability, etc.), the type of image to be printed (i.e., permanent or removable), methods to be used for removing the image, container handling constraints, intended function of the post-coat material, or the like.

In some embodiments, the system may determine that a post-coat layer will be applied if an image is a removable image to provide removability properties to the image under certain conditions. For example, the post-coat layer composition may be selected to lend removability properties to the marking material. For example, the post-coat material may be selected such that upon application, it alters the properties of the marking material to reduce the adhesion of the marking material to the container surface. Alternatively, the post-coat layer may be selected to prevent damage to the image during transportation or handling but which may be removed at suitable temperature, pressure, pH, solvent exposure, etc. to allow for subsequent removal of the marking material. For example, the marking material may be selected such that after removal of the post-coat layer using a suitable method, the marking material may simply be rubbed off, washed, or otherwise removed to remove the image.

In another embodiment, the system may determine that a post-coat layer will be applied if an image is a permanent image. For example, the composition of a post-coat layer may be selected to make an image a permanent image by, for example, adding a protective coat over the marking material that prevents removal of the marking material, by improving the adhesiveness of the marking material, or the like.

Alternatively, the system may determine that a post-coat layer needs to be applied based on other image properties such as, without limitation, to provide desired visual characteristics such as a matte finish, gloss, smooth finish, etc.

At 405, the print system may print the plurality of images on the surface of the container as discussed above with respect to FIG. 1. Specifically, the controller of the print system may control one or more of the pre-coat applicators, the print heads, and/or the post-coat applicators to apply the suitable layers (as determined in step 403) for printing each of the plurality of images. The controller may also control the relative movement of the one or more of the pre-coat applicators, the print heads, and/or the post-coat applications with respect to the container holder to print the images at the desired location (determined based on the metadata of each image/image portion) on the container surface.

Figure 5:
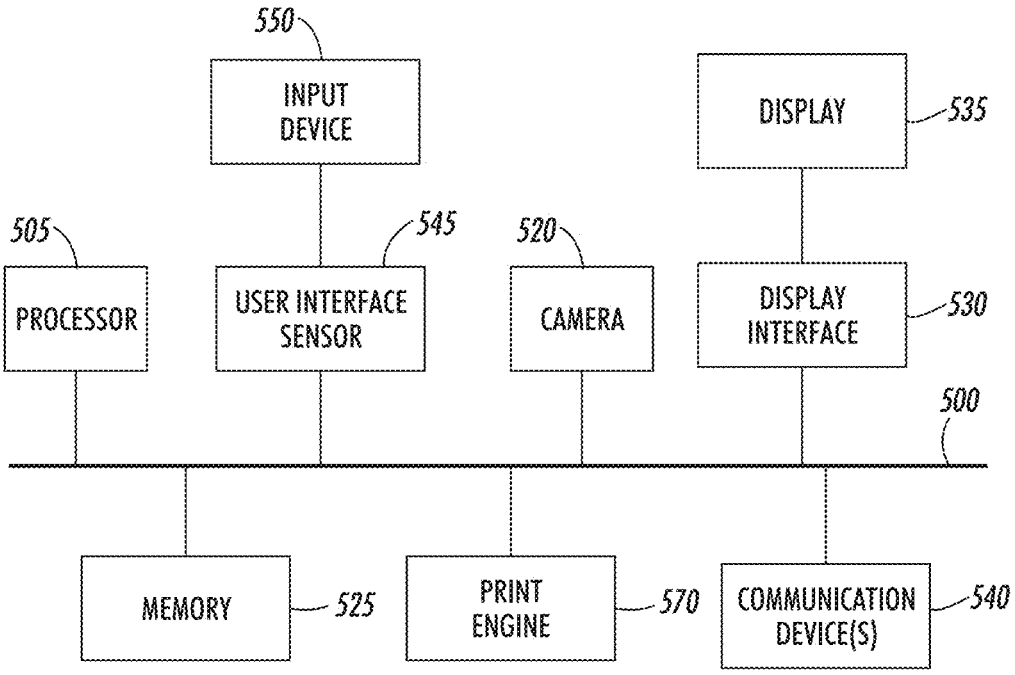
FIG. 5 depicts various embodiments of one or more electronic devices for implementing the various methods and processes described herein.

FIG. 5 depicts an example of internal hardware that may be included in any of the electronic components of the system, such as a print system having a processing capability, or a local or remote computing device that is in communication with the print system. An electrical bus 500 serves as an information highway interconnecting the other illustrated components of the hardware. Processor 505 is a central processing device of the system, configured to perform calculations and logic operations required to execute programming instructions. As used in this document and in the claims, the terms "processor" and "processing device" may refer to a single processor or any number of processors in a set of processors that collectively perform a set of operations, such as a central processing unit (CPU), a graphics processing unit (GPU), a remote server, or a combination of these. Read only memory (ROM), random access memory (RAM), flash memory, hard drives and other devices capable of storing electronic data constitute examples of memory devices 525 that may store the programming instructions. A memory device may include a single device or a collection of devices across which data and/or instructions are stored. Various embodiments of the invention may include a computer-readable medium containing programming instructions that are configured to cause one or more processors, print devices and/or scanning devices to perform the functions described in the context of the previous figures.

An optional display interface 530 may permit information from the bus 500 to be displayed on a display device 535 in visual, graphic or alphanumeric format. An audio interface and audio output (such as a speaker) also may be provided. Communication with external devices may occur using various communication devices 540 such as a wireless antenna, an RFID tag and/or short-range or near-field communication transceiver, each of which may optionally communicatively connect with other components of the device via one or more communication system. The communication device(s) 540 may be configured to be communicatively connected to a communications network, such as the Internet, a local area network or a cellular telephone data network.

The hardware may also include a user interface sensor 545 that allows for receipt of data from input devices 550 such as a keyboard, a mouse, a joystick, a touchscreen, a touch pad, a remote control, a pointing device and/or microphone. In embodiments where the electronic device is the smartphone or another image capturing device, digital images of a document or other image content may be acquired via a camera 520 that can capture video and/or still images. In embodiments where the electronic device includes a print device, the print device may include a print engine 570 with components such as a print head, document feeding system and other components typically used in print devices.

It will be understood to those skilled in the art that while the above description describes one-step printing of permanent and/or removable images on the surface of a container, similar principles can be applied for one-step printing of permanent and/or removable images on any object irrespective of the shape, size, surface material, etc. of the object.

In certain embodiments, the print system of FIG. 1 may also include a 3-D printer such that the print system can be configured to print a 3D object, and permanent and removable images on the printed 3D object in one print cycle.

The above-disclosed features and functions, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

The invention claimed is:

1. A method for printing a plurality of images on an object, the method comprising, by a processor:

receiving a digital file comprising a plurality of images to be printed on an object, wherein the plurality of images comprise one or more removable images and one or more permanent images;

for each of the plurality of images:

determine whether that image is a removable image or a permanent image, identify, based on the determination, at least one layer to be used for printing that image in addition to a marking material layer, wherein the at least one layer comprises a pre-coat layer applied under the marking material layer or a post-coat layer applied over the marking material layer, determine a composition of the marking material layer, and determine a composition of the at least one layer, wherein if that image is determined to be a removable image, determining the composition of the at least one layer comprises:

determining the composition to improve removability of the marking material layer from a surface of the object, and determining that the at least one layer is a pre-coat layer whose composition is determined based on at least one of the following:

a pre-coat layer that has a thermal expansion coefficient that is different from that of the object surface, a pre-coat layer that has a solubility coefficient that makes it soluble in one or more solvents such that the pre-coat layer and the marking material layer applied over it may be removed by subjecting the object to the one or more solvents, a pre-coat layer that is soluble in one or more solvents at a pre-determined pH such that the pre-coat layer and the marking material layer applied over it may be removed by subjecting the object to the one or more solvents at the pre-determined pH; or a pre-coat layer that forms a substrate under the marking material layer such that that image can be removed by peeling off the substrate;

operating a plurality of print heads to eject marking material based on the determined composition of the marking material layer for each of the plurality of images; and operating a plurality of layer applicators to apply the identified at least one layer based on the determined composition of the at least one layer for each of the plurality of images by applying the marking material layer over the at least one layer if it is a pre-coat layer and under the at least one layer if it is a post-coat layer.

2. The method of claim 1, wherein the digital file further comprises metadata corresponding to each of the plurality of images that comprises at least one of the following: color information, background information, location of printing an image, information relating to whether an image removable or permanent, or information relating to whether a portion of an image is removable or permanent.

3. The method of claim 1, wherein determining whether that image is a removable image or a permanent image comprises making the determination based on at least one of the following: metadata associated with that image, type of information included in that image, location of that image on the object, user instructions, or a type of the object.

4. The method of claim 1, wherein identifying, based on the determination, at least one layer to be used for printing that image in addition to the marking material layer comprises making the identification based on at least one of the following rules:

a pre-coat layer if that image is determined to be a permanent image;

a post-coat layer if that image is determined to be a permanent image;

a pre-coat layer if that image is determined to be a removable image; or a post-coat layer if that image is determined to be a permanent image.

5. The method of claim 1, further comprising:

determining that the composition is the pre-coat layer that forms the substrate under the marking material layer such that that image can be removed by peeling off the substrate; and applying a removable tab to a portion, but not all, of the substrate.

6. The method of claim 1, wherein determining the composition of the at least one layer when that image is determined to be a removable image and the at least one layer is identified as a post-coat layer, comprises determining the composition based on at least of the following:

a post-coat layer that alters the properties of the marking material layer to reduce adhesion of the marking material layer to the object surface; or a post-coat layer that prevents damage to that image during transportation or handling but which is removable at suitable temperature, pressure, pH, or solvent exposure.

7. The method of claim 1, wherein determining the composition of the at least one layer when that image is determined to be a permanent image comprises determining the composition to improve adhesion of the marking material layer to a surface of the object.

8. The method of claim 7, wherein determining the composition of the at least one layer when that image is determined to be a permanent image and the at least one layer is identified as a pre-coat layer, comprises determining the composition based on at least of the following:

chemical composition of a surface of the object; or chemical composition of the marking material.

9. The method of claim 7, wherein determining the composition of the at least one layer when that image is determined to be a permanent image and the at least one layer is identified as a post-coat layer, comprises determining the composition the post-coat layer such that it forms a protective coat over the marking material layer that prevents removal of the marking material layer.

10. The method of claim 1, wherein determining the composition of the marking material comprises determining the composition based on at least the following: metadata associated with that image, properties of the at least one layer, or the determination whether that image is a permanent image or a removable image.

11. The method of claim 1, wherein at least one of the plurality of images comprises a removable image portion and a permanent image portion.

12. The method of claim 11, wherein at least a first layer is selected for printing the removable image portion in addition to a first marking material layer and at least a second layer is selected for printing the permanent image portion in addition to a second marking material layer.

13. The method of claim 1, wherein the object is a product container and the one or more removable images are printed on the product container such that they can be removed by a user before recycling the product container.

14. A method for printing a plurality of images on an object, the method comprising, by a processor:

receiving a digital file comprising a plurality of images to be printed on an object, wherein the plurality of images comprise one or more removable images and one or more permanent images;

for each of the plurality of images:

determine whether that image is a removable image or a permanent image, identify, based on the determination, at least one layer to be used for printing that image in addition to a marking material layer, wherein the at least one layer comprises a pre-coat layer applied under the marking material layer or a post-coat layer applied over the marking material layer, determine a composition of the marking material layer, and determine a composition of the at least one layer, wherein if that image is determined to be a removable image, determining the composition of the at least one layer comprises:

determining the composition to improve removability of the marking material layer from a surface of the object, and determining that the at least one layer is a post-coat layer whose composition is determined based on at least one of the following:

a post-coat layer that alters the properties of the marking material layer to reduce adhesion of the marking material layer to the object surface; or a post-coat layer that prevents damage to that image during transportation or handling but which is removable at suitable temperature, pressure, pH, or solvent exposure;

operating a plurality of print heads to eject marking material based on the determined composition of the marking material layer for each of the plurality of images; and operating a plurality of layer applicators to apply the identified at least one layer based on the determined composition of the at least one layer for each of the plurality of images by applying the marking material layer over the at least one layer if it is a pre-coat layer and under the at least one layer if it is a post-coat layer.

15. The method of claim 14, wherein the digital file further comprises metadata corresponding to each of the plurality of images that comprises at least one of the following: color information, background information, location of printing an image, information relating to whether an image removable or permanent, or information relating to whether a portion of an image is removable or permanent.

16. The method of claim 14, wherein determining whether that image is a removable image or a permanent image comprises making the determination based on at least one of the following: metadata associated with that image, type of information included in that image, location of that image on the object, user instructions, or a type of the object.

17. The method of claim 14, wherein identifying, based on the determination, at least one layer to be used for printing that image in addition to the marking material layer comprises making the identification based on at least one of the following rules:

a pre-coat layer if that image is determined to be a permanent image;

a post-coat layer if that image is determined to be a permanent image;

a pre-coat layer if that image is determined to be a removable image; or a post-coat layer if that image is determined to be a permanent image.

18. The method of claim 14, further comprising:

determining that the composition is the pre-coat layer that forms the substrate under the marking material layer such that that image can be removed by peeling off the substrate; and applying a removable tab to a portion, but not all, of the substrate.

19. The method of claim 14, wherein determining the composition of the at least one layer when that image is determined to be a permanent image comprises determining the composition to improve adhesion of the marking material layer to a surface of the object.

20. The method of claim 19, wherein determining the composition of the at least one layer when that image is determined to be a permanent image and the at least one layer is identified as a pre-coat layer, comprises determining the composition based on at least of the following:

chemical composition of a surface of the object; or chemical composition of the marking material.

21. The method of claim 19, wherein determining the composition of the at least one layer when that image is determined to be a permanent image and the at least one layer is identified as a post-coat layer, comprises determining the composition the post-coat layer such that it forms a protective coat over the marking material layer that prevents removal of the marking material layer.

22. The method of claim 14, wherein determining the composition of the marking material comprises determining the composition based on at least the following: metadata associated with that image, properties of the at least one layer, or the determination whether that image is a permanent image or a removable image.

23. The method of claim 14, wherein at least one of the plurality of images comprises a removable image portion and a permanent image portion.

24. The method of claim 23, wherein at least a first layer is selected for printing the removable image portion in addition to a first marking material layer and at least a second layer is selected for printing the permanent image portion in addition to a second marking material layer.

25. The method of claim 14, wherein the object is a product container and the one or more removable images are printed on the product container such that they can be removed by a user before recycling the product container.

* * * * *